US006412906B1

(12) United States Patent
Lin

(10) Patent No.: US 6,412,906 B1
(45) Date of Patent: Jul. 2, 2002

(54) SCRAPER FOR A WIPER IN AN INK JET SERVICE STATION

(75) Inventor: Tsung-Te Lin, San-Chung (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 19 days.

(21) Appl. No.: 09/740,892

(22) Filed: Dec. 21, 2000

(51) Int. Cl.[7] ..... B41J 2/165
(52) U.S. Cl. ..... 347/33; 347/22
(58) Field of Search ..... 347/33, 22, 32; 15/256.5, 256.52, 256.53

(56) References Cited

U.S. PATENT DOCUMENTS 6,151,044 A * 11/2000 Gaasch ..... 347/33

* cited by examiner

*Primary Examiner*—John Barlow
*Assistant Examiner*—Shih-Wen Hsieh
(74) *Attorney, Agent, or Firm*—Winston Hsu

(57) ABSTRACT

An ink jet service station has a housing with a right wall and a left wall, and a carriage for holding a wiper. The carriage is moveably installed in the housing, and a scraper is rotatably mounted on the carriage. When the carriage moves to the left wall, the scraper contacts the left wall. A first torque is thus placed upon the scraper that causes the scraper to rotate to the right and scrape the wiper. When the carriage moves to the right wall, the scraper contacts the right wall and a second torque is placed upon the scraper that causes the scraper to rotate to the left and scrape the wiper.

9 Claims, 7 Drawing Sheets

SCRAPER FOR A WIPER IN AN INK JET SERVICE STATION

BACKGROUND OF THE INVENTION

1. Field of the Invention

The present invention relates to an ink jet service station. More specifically, the present invention discloses a scraper for a wiper in an ink jet service station.

2. Description of the Prior Art

Ink jet printing systems are found in a variety of faxes, printers and other types of office equipment. To ensure the continuous proper operation of an ink jet print head within the ink jet printing system, the ink jet printing system has an ink jet service station. The ink jet service station performs basic head cleaning and capping functions. The ink jet nozzles of the print head are capped when the printing system is not in use. This prevents the nozzles from drying out, and thus becoming clogged. Prior to printing, and at periodic intervals during a printing session, the ink jet nozzles are wiped clean to ensure their performance. A wiper in the ink jet service station performs this wiping function. Over periods of prolonged use, however, the wiper itself can become clogged with ink. That is, enough ink can build up on the wiper that it can adversely affect the ability of the wiper to properly clean the print head.

SUMMARY OF THE INVENTION

It is therefore a primary objective of this invention to provide a scraper in an ink jet service station that scrapes ink from a wiper so that the wiper may more effectively wipe clean an ink jet print head.

The present invention, briefly summarized, discloses a scraper for a wiper in an ink jet service station. The ink jet service station has a housing with a right wall and a left wall, and a carriage for holding the wiper. The carriage is moveably installed in the housing, and the scraper is rotatably mounted on the carriage. When the carriage moves to the left wall, the scraper contacts the left wall. A first torque is thus placed upon the scraper that causes the scraper to rotate to the right and scrape the wiper. When the carriage moves to the right wall, the scraper contacts the right wall and a second torque is placed upon the scraper that causes the scraper to rotate to the left and scrape the wiper.

It is an advantage of the present invention that the wiper, in conjunction with the scraper, is better able to effect cleaning of the ink jet print head, as the scraper prevents any buildup of ink on the wiper.

This and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
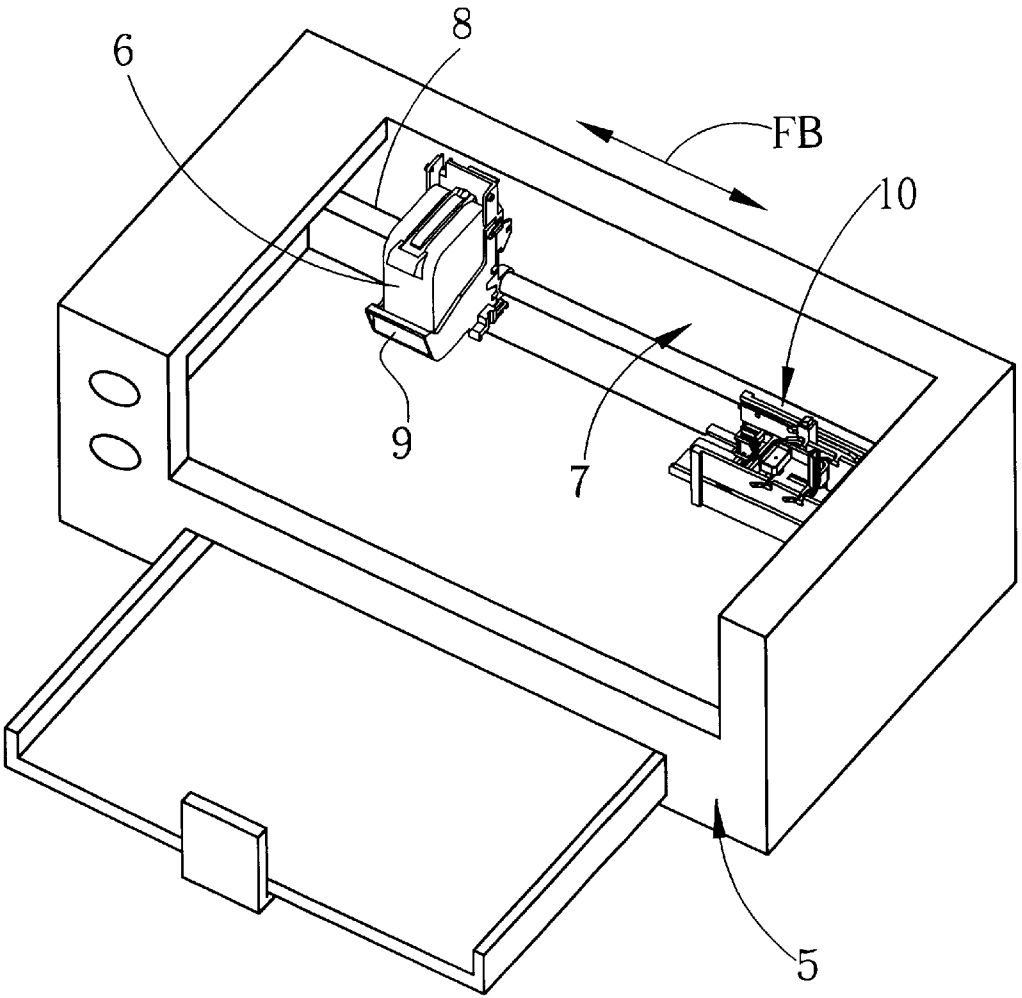
FIG. 1 is a perspective view of a present invention ink jet service station installed in a printing device.
Figure 2:
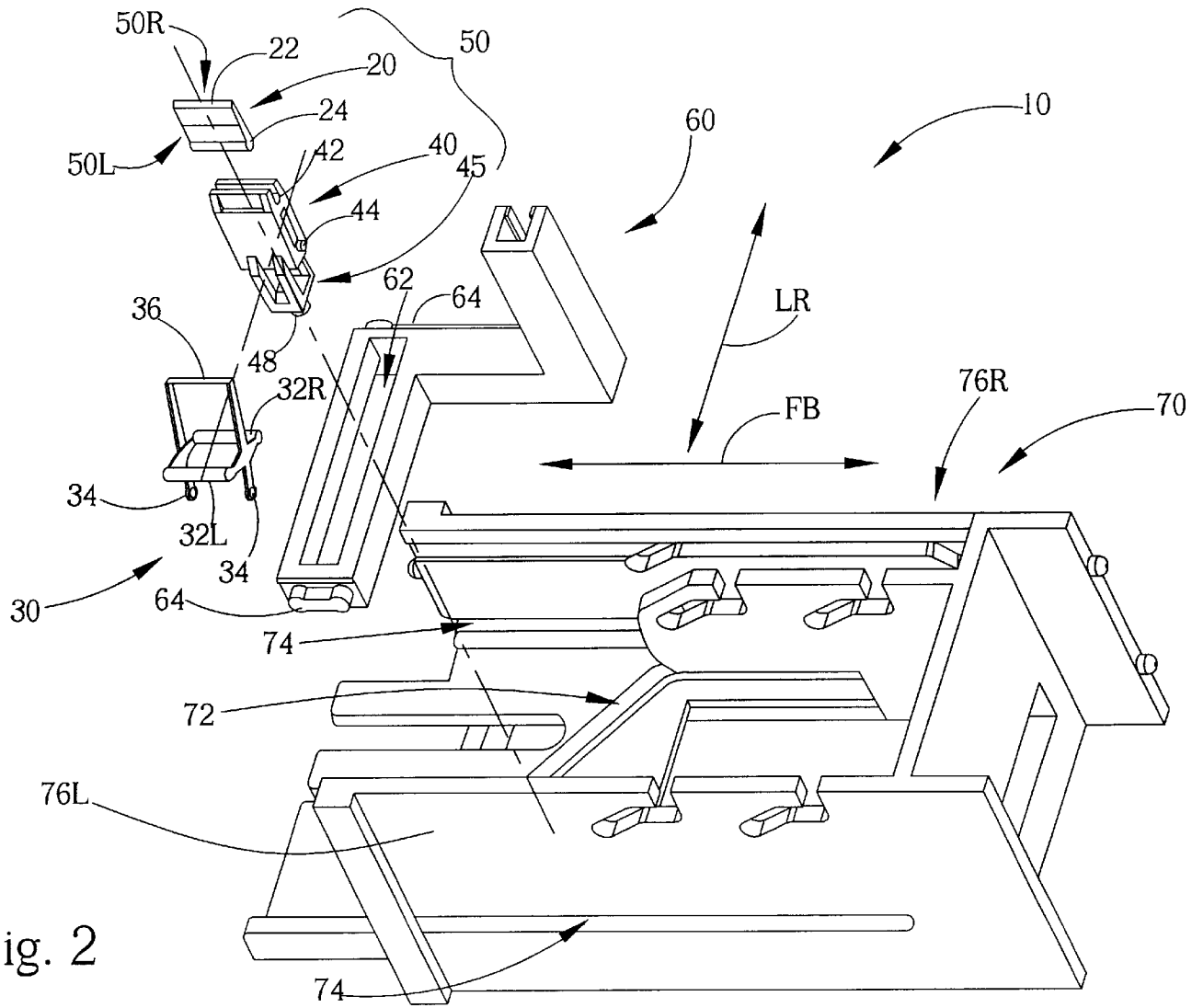
FIG. 2 is an exploded view diagram of an ink jet service station of the present invention.
Figure 3:
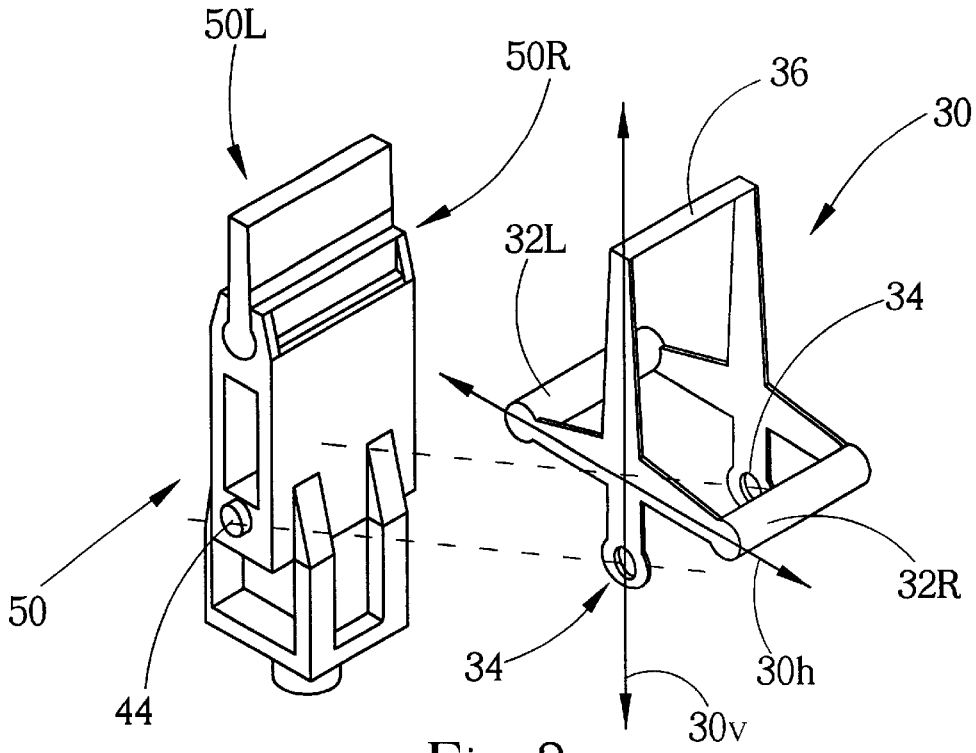
FIG. 3 is an exploded view diagram of a wiping assembly and scraper of the present invention.
Figure 4:
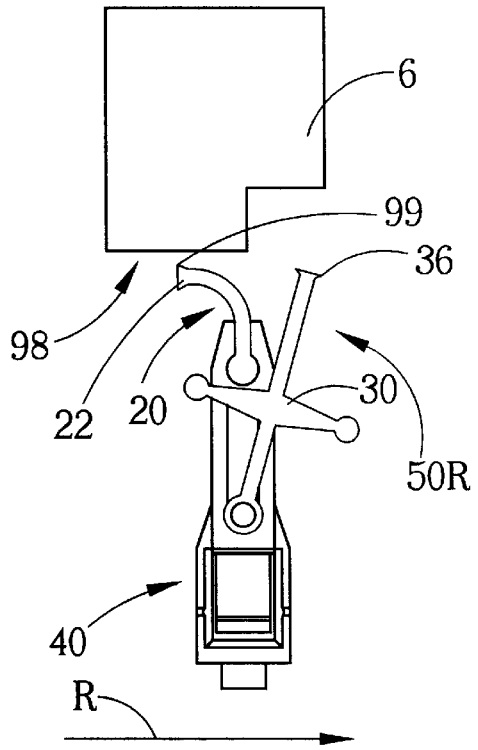
FIG. 4 to FIG. 7 are sequence diagrams of a wiper and a scraper of the present invention performing wiping and scraping operations, respectively.

Please refer to FIG. 1 to FIG. 3. FIG. 1 is a perspective view of a present invention ink jet service station 10 installed in a printing device 5. FIG. 2 is an exploded view diagram of the ink jet service station 10. FIG. 3 is an exploded view diagram of a wiping assembly 50 and scraper 30 of the present invention. The exact function of the printing device 5 is not relevant to the present invention, and may be any device that uses ink jet printing technology. A carrier 9 is mechanically connected to a driving device 8 that moves the carrier 9 forward and backward along a print track 7. This forward and backward movement is indicated by arrow FB. Installed in the carrier 9 is an ink jet cartridge 6. The ink jet cartridge 6 holds the ink (not shown) required for printing, and on its underside has an ink jet print head (not shown) that performs the actual printing operation as the cartridge 6 is moved forward and backward by the carrier 9. The ink jet service station 10 is used to wipe the ink jet print head, and perform other servicing functions, such as capping of the print head during printing down time.

The ink jet service station 10 is mounted at an end of the print track 7. In order to perform a wiping operation, the carrier 9 moves in a forward direction and brings the ink jet cartridge 6 into the ink jet service station 10. Once inside the ink jet service station 10, the carrier 9 moves the ink jet cartridge 6 forward and backward along the print track 7, the arrow FB, to perform the wiping operation of the ink jet print head. The wiping is performed by a wiper 20 of a wiping assembly 50. The wiper 20 is made of a soft, flexible material, such as rubber, and acts something like a squeegee to remove excess ink from the ink jet print head. The same forward and backward movement of the ink jet print head in the service station 10 initiates a scraping operation of the wiper 20. The scraping is performed by a scraper 30, which is rotatably mounted on the wiping assembly 50.

An upper surface 22 of the wiper 20 performs the actual wiping of the ink jet print head. A lower portion 24 of the wiper 20 is used to removably fix the wiper 20 into a carriage 40. The carriage 40 has a slot 42 into which the lower portion 24 of the wiper 20 is disposed. The wiper 20 is thus securely fastened to the carriage 40, but the wiper 20 may also be removed and replaced with a new wiper 20. The carriage 40 also has two pins 44 on opposing sides of the carriage 40 that are used to rotatably mount the scraper 30.

The scraper 30 is a rigid structure, and is made of plastic, though any other suitable material may of course be used. The cross section of scraper 30 is shaped something like a cross, with a vertical axis 30*v* and a horizontal axis 30*h*. The horizontal axis 30*h* is used to mount a left contact bar 32L and a right contact bar 32R. The left contact bar 32L is to the left of the vertical axis 30*v*. The right contact bar 32R is to the right of the vertical axis 30*v*. The upper portion of the vertical axis 30*v* is used to mount a blade 36. The lower portion of the vertical axis 30*v* is used to rotatably connect the scraper 30 to the wiping assembly 50, and has two pivot holes 34. Each pivot hole 34 engages with a corresponding pin 44. The pin 44 slides into and mates with the pivot hole 34. By rotating about the pivot holes 34 on the pins 44, the blade 36 can swing to a right side 50R of the wiping assembly 50, and to a left side 50L of the wiping assembly 50. When the blade 36 rotates from the left side 50L to the right side 50R, and vice versa, it scrapes the wiper 20. Specifically, the blade 36 scrapes the upper surface 22 of the wiper 20. In this manner, the scraper 30, rotatably mounted on the carriage 40 scrapes the wiper 20.

The carriage 40 is slidably disposed on a sled 60. The sled 60 has a first track 62, which is a slot running along a left and right direction, as indicated by arrow LR. A bottom portion 45 of the carriage 40 slides within the first track 62. In this manner, the wiping assembly 50, with the scraper 30, can slide left and right on the first track 62 along the arrow LR. The sled 60 is slidably installed inside a housing 70 of the ink jet service station 10. The housing 70 has a left wall 76L, and a right wall 76R. The surfaces of the walls 76L and 76R are essentially parallel to each other. The walls 76L and 76R each have a slot track 74. The two slot tracks 74 each slidingly engage a corresponding pin 64 on the sled 60. In this manner, the sled 60 can slide within the housing 70 in the forward and backward direction of the arrow FB. Consequently, the sliding direction FB of the sled 60 in the housing 70 is perpendicular to the sliding direction LR of the carriage 40 on the first track 62. The first track 62 thus runs in a perpendicular manner between the two walls 76L and 76R, and the carriage 40 can slide between the two walls 76L and 76R.

Not only does the carriage 40 slidingly engage with the sled 60, but it also slidingly engages with the housing 70. The housing 70 further comprises a second track 72 that is installed under the sled 60. The second track 72 is also a slot track, and runs diagonal to the first track 62 and the slots 74. Hence, the second track 72 is diagonal to both the FB and the LR directions A pin 48 on the bottom of the carriage 40 slidingly engages the second track 72. In this manner, as the sled 60 moves along the direction FB, the interaction of the carriage 40 with the second track 72 forces the carriage 40 to move along the direction LR on the first track 62. The movement of the sled 60 is effected by the carrier 9 as the carrier 9 moves the ink jet print head along the direction FB in the housing 70 of the ink jet service station 10. As the ink jet print head moves along the FB direction, the carriage 40 moves in the LR direction along the first track 62 and the upper surface 22 of the wiper 20 wipes the ink jet print head.

Please refer to FIG. 4 to FIG. 7 in reference with FIG. 1 to FIG. 3. FIG. 4 to FIG. 7 are sequence diagrams of the wiper 20 and scraper 30 performing wiping and scraping operations, respectively. Initially, in FIG. 4, the carrier 9 moves forward along the direction FB, bringing the ink jet print cartridge 6 into the housing 70. As the cartridge 6 moves forward, the sled 60 is also moved forward. The forward movement of the sled 60 causes the carriage 40 to move right, as indicated by arrow R. The arrow R simply represents rightward movement along the direction LR. As the carriage 40 moves right, the upper surface 22 of the wiper 20 wipes print head 98 on the bottom of the ink jet print cartridge 6. In so doing, the wiper 20 removes excess ink 99 from the ink jet print head 98. The blade 36 of the scraper 30 stands on the right side 50R of the wiping assembly 50.

Figure 5:
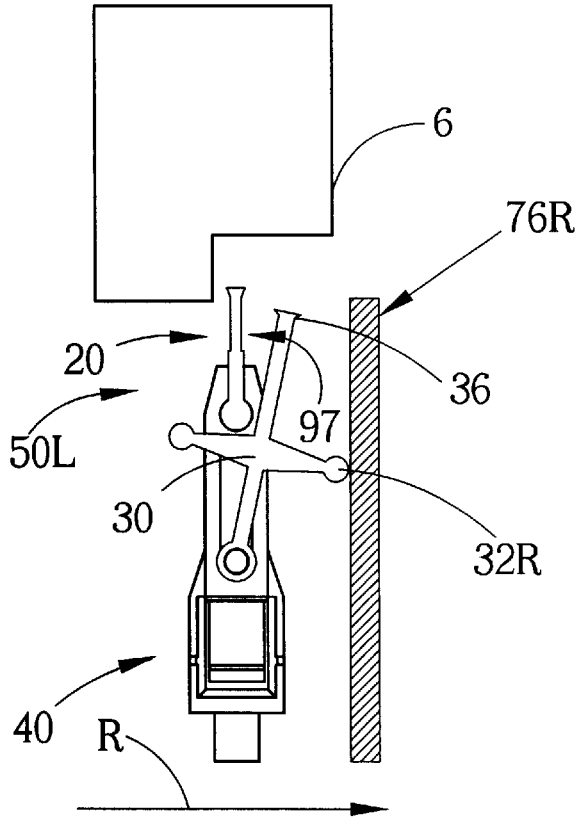

As shown in FIG. 5, the continued forward movement of the print head 98 causes the carriage 40 to move further along the direction R until the right contact bar 32R comes into contact with the right wall 76R. The reactive force of the contact bar 32R with the right wall 76R places a leftward-moving torque 97 on the scraper 30. The leftward-moving torque 97 moves the blade 36 towards the left side 50L of the wiping assembly 50. The contact of the contact bar 32R with the wall 76R occurs after the wiper 20 has wiped the print head 98.

Figure 6:
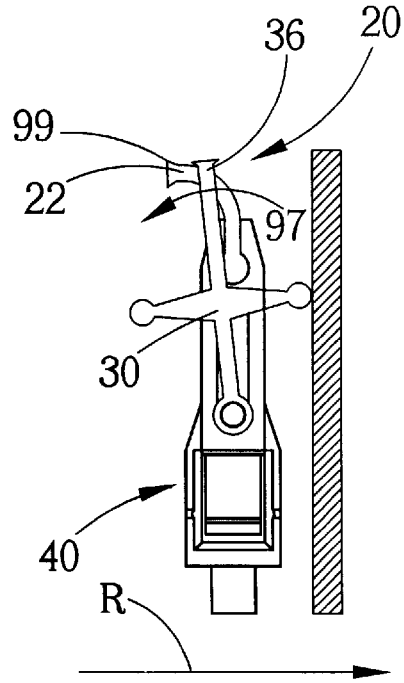

As shown in FIG. 6, the print head 98 continues to drive the carriage 40 along the direction R. The blade 36 of the scraper 30, driven by the leftward-moving torque 97, passes over the wiper 20, scraping the upper surface 22 of the wiper 20. As the blade 36 scrapes the upper surface 22, it removes the excess ink 99 from the upper surface 22 of the wiper 20.

Figure 7:
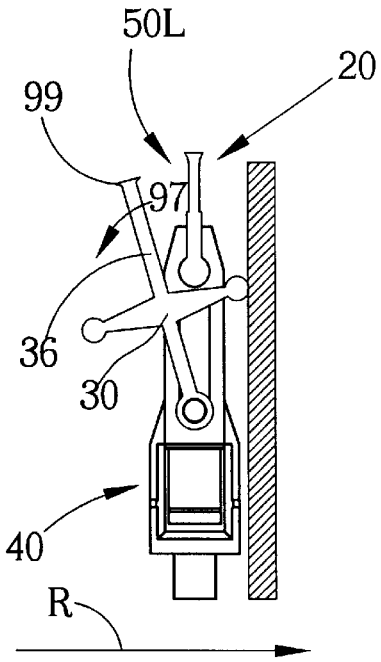

Finally, as shown in FIG. 7, at the farthest rightward movement of the carriage 40, the leftward-moving torque 97 brings the blade 36 of the scraper 30 fully over the to the left side 50L of the wiping assembly 50. The excess ink 99 is scraped off of the wiper 20 by the blade 36. Usually very little excess ink 99 will remain on the blade 36 of the scraper, as the blade 36 is quite narrow. Instead, the excess ink 99 will fall from the blade 36, and can be caught at the bottom of the ink jet service station 10.

An almost identical wiping and scraping process occurs when the ink jet print head 98 moves backwards in the ink jet service station 10. Please refer to FIG. 8 to FIG. 11, in conjunction with FIG. 1 to FIG. 3. FIG. 8 to FIG. 11 are sequence diagrams of the wiper 20 and scraper 30 performing wiping and scraping operations, respectively. In this case, however, the sled 60 and the ink jet print head 98 are moving backwards in the housing 70 along the arrow FB.

Figure 8:
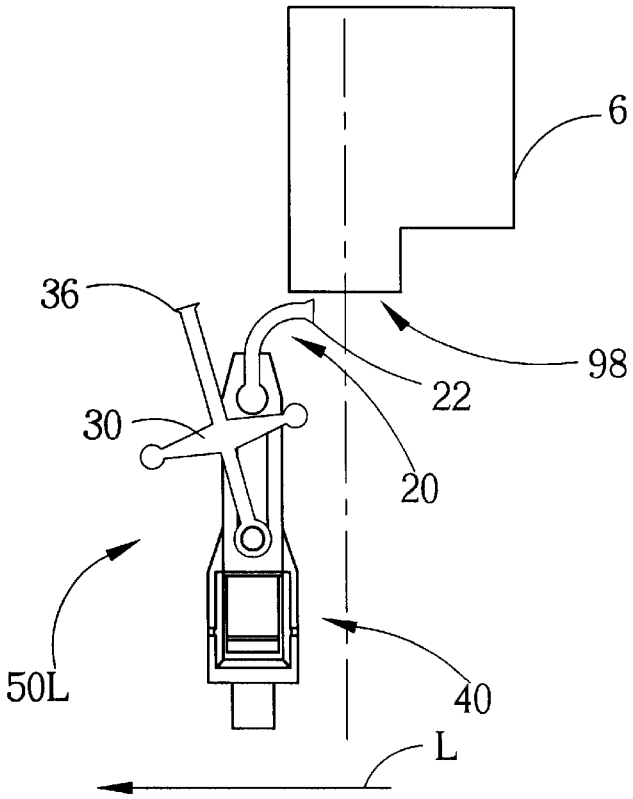
FIG. 8 to FIG. 11 are sequence diagrams of a wiper and a scraper of the present invention performing wiping and scraping operations, respectively.

In FIG. 8, the carrier 9 moves backward along the direction FB, bringing the ink jet print cartridge 6 out of the housing 70. As the cartridge 6 moves backward, the sled 60 is also moved backward. The backward movement of the sled 60 causes the carriage 40 to move left, as indicated by arrow L. The arrow L simply represents leftward movement along the direction LR. As the carriage 40 moves left, the upper surface 22 of the wiper 20 wipes the print head 98. The wiper 20 thus removes the excess ink 99 from the ink jet print head 98. The blade 36 of the scraper 30 stands on the left side 50L of the wiping assembly 50.

Figure 9:
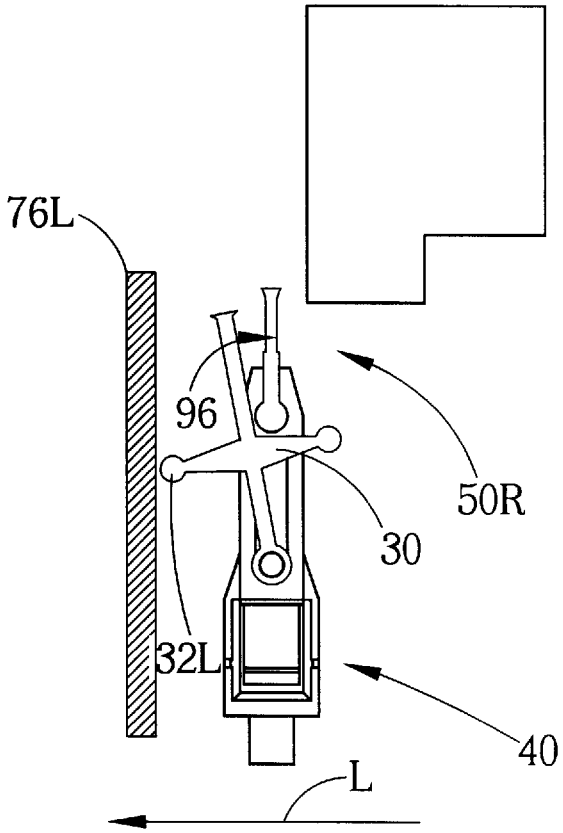

As shown in FIG. 9, the continued backward movement of the print head 98 causes the carriage 40 to move further along the direction L until the left contact bar 32L comes into contact with the left wall 76L. The reactive force of the contact bar 32L with the left wall 76L places a rightward-moving torque 96 on the scraper 30. The rightward-moving torque 96 moves the blade 36 towards the right side 50R of the wiping assembly 50. The contact of the contact bar 32L with the wall 76L occurs after the wiper 20 has wiped the print head 98.

Figure 10:
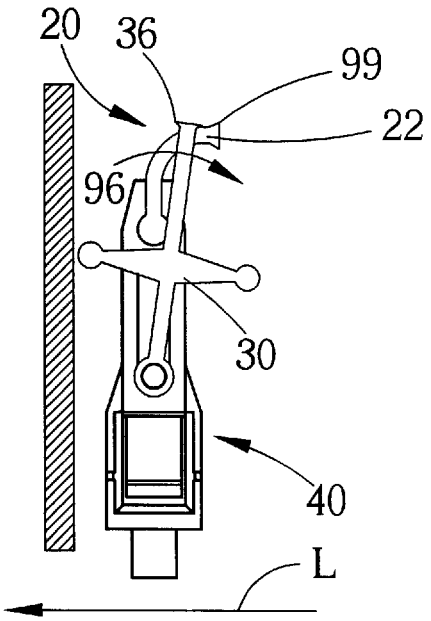

As shown in FIG. 10, the print head 98 continues to drive the carriage 40 along the direction L. The blade 36 of the scraper 30, driven by the rightward-moving torque 96, passes over the wiper 20, scraping the upper surface 22 of the wiper 20. As the blade 36 scrapes the upper surface 22, it removes the excess ink 99 from the upper surface 22 of the wiper 20.

Figure 11:
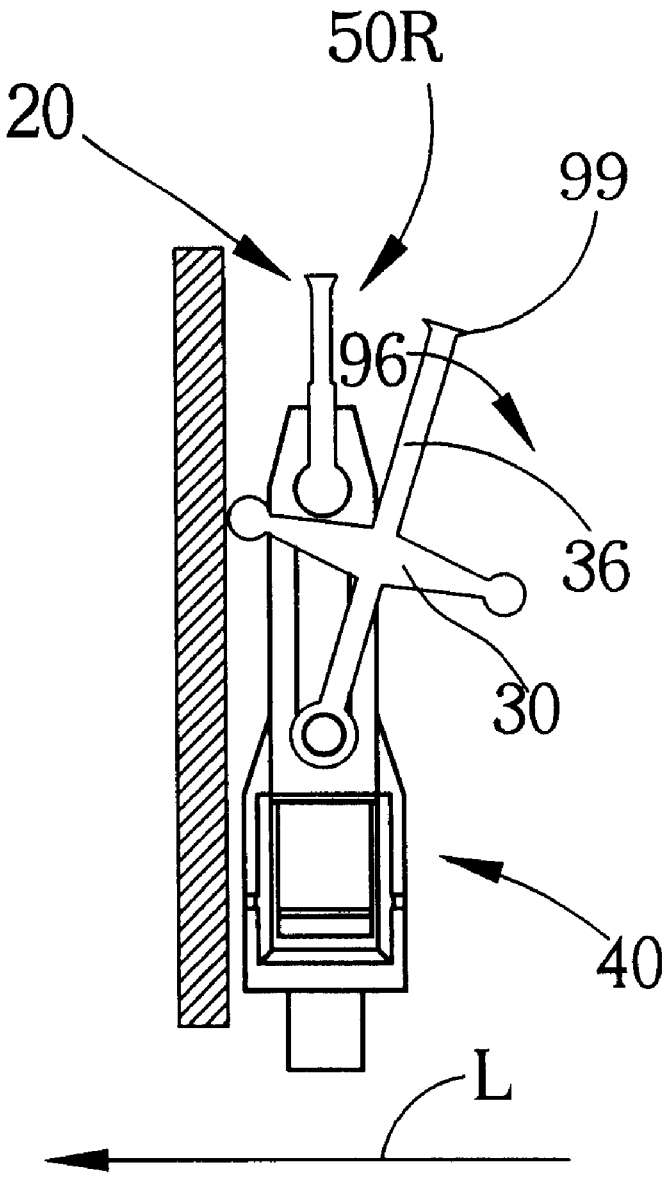

Finally, as shown in FIG. 11, at the farthest leftward movement of the carriage 40, the rightward-moving torque 96 brings the blade 36 of the scraper 30 fully over the wiper 20 to the right side 50R of the wiping assembly 50. The excess ink 99 is scraped off of the wiper 20 by the blade 36.

In short, the contact bars 32R and 32L are used to generate reactive forces with the walls 76R and 76L of the housing 70, respectively. These reactive forces place a torque on the vertical axis 30*v* of the scraper 30 that tends to rotate the blade 36 to either the right side 50R or left side 50L of the wiping assembly 50. As the blade 36 switches sides, it scrapes the wiper 20. By scraping the excess ink 99 from the wiper 20, the scraper 30 ensures that wiper 20 can more effectively clean the ink jet print head 98.

In short, the contact bars 32R and 32L are used to generate reactive forces with the walls 76R and 76L of the housing, respectively. These reactive forces place a torque on the vertical axis 30*v* of the scraper 30 that tends to rotate the blade 36 to either the right side 50R or left side 50L of the wiping assembly 50. As the blade 36 switches sides, it scrapes the wiper 20. By scraping the excess ink 99 from the wiper 20, the scraper 30 ensures that wiper 20 can more effectively clean the ink jet print head 98. It should be clear to one in the art that the contact bars 32R and 32L must be mounted suitably high up the vertical axis 30*v* to insure that a proper torque is placed on the vertical axis 30*v*. That is, the contact bars 32R and 32L should be disposed so that they are horizontally arranged close to or above the center of the vertical axis 30*v*.

In contrast to the prior art, the present invention uses a scraper rotatably mounted on a wiping assembly to scrape excess ink from a wiper of the wiping assembly. By removing excess ink from the wiper, the scraper helps the wiper to better clean an ink jet print head.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink jet service station for an ink jet printing system, the ink jet service station comprising:

a wiper;

a housing with a right wall and a left wall;

a carriage for holding the wiper, the carriage moveably installed in the housing; and a scraper rotatably mounted on the carriage;

wherein when the carriage moves to the left wall and the scraper contacts the left wall, a first torque is placed upon the scraper that causes the scraper to rotate to the right and scrape the wiper, and when the carriage moves to the right wall and the scraper contacts the right wall, a second torque is placed upon the scraper that causes the scraper to rotate to the left and scrape the wiper.

2. The ink jet service station of claim 1, wherein the scraper comprises:

a vertical axis comprising:

a blade for scraping the wiper, the blade at the top of the vertical axis; and a pivot for rotatably fixing the scraper to the carriage, the pivot at the bottom of the vertical axis; and a horizontal axis comprising:

a left contact bar for contacting the left wall of the housing to generate the first torque on the vertical axis, the left contact bar to the left of the vertical axis; and a right contact bar for contacting the right wall of the housing to generate the second torque on the vertical axis, the right contact bar to the right of the vertical axis;

wherein when the blade is on the left side of the wiper and the carriage causes the left contact bar to contact the left wall of the housing and generate the first torque on the vertical axis, the blade rotates to the right, scrapes the wiper and stops on the right side of the wiper, and when the blade is on the right side of the wiper and the carriage causes the right contact bar to contact the right wall of the housing and generate the second torque on the vertical axis, the blade rotates to the left, scrapes the wiper and stops on the left side of the wiper.

3. The ink jet service station of claim 1 further comprising a sled installed within the housing, the sled comprising a first track that is predominantly perpendicular to the left wall and to the right wall and running between the left wall and the right wall; wherein the carriage is moveably installed on the first track for moving between the left wall and the right wall.

4. The ink jet service station of claim 3 wherein the sled is moveably installed within the housing along a forward and backward direction, and the housing further comprises a second track installed under the sled, the second track diagonal to both the first track and to the forward and backward direction, and the carriage is moveably installed on the second track; wherein when the sled moves in the forward and backward direction, the interaction of the carriage with the second track forces the carriage to move along the first track.

5. The ink jet service station of claim 4 wherein the ink jet service station is used to service an ink jet print head of a printing device, the ink jet print head moving in the forward and backward direction along a print track, the ink jet service station mounted at one end of the print track; wherein the forward and backward movement of the ink jet print head in the ink jet service station drives the sled in the forward and backward direction, causes the wiper on the carriage to move along the first track to wipe the ink jet print head, and causes the scraper to scrape the wiper.

6. The ink jet service station of claim 5 wherein the scraper scrapes excess ink from the wiper so that the wiper more cleanly wipes the ink jet print head.

7. A scraper for a wiper in an ink jet service station, the wiper having a right side and a left side, the wiper held by a carriage, the scraper rotatably mounted on the carriage, the scraper comprising:

a vertical axis comprising:

a blade for scraping the wiper, the blade at the top of the vertical axis; and a bottom for pivotally fixing the scraper to the carriage; and a horizontal axis comprising:

a left contact bar for contacting a first wall of a housing to generate a first torque on the vertical axis, the left contact bar to the left of the vertical axis; and a right contact bar for contacting a second wall of the housing to generate a second torque on the vertical axis, the right contact bar to the right of the vertical axis.

8. The scraper of claim 7, wherein when the blade is on the left side of the wiper and the left contact bar contacts the first wall of the housing to generate the first torque on the vertical axis, the blade rotates to the right, scrapes the wiper and stops on the right side of the wiper.

9. The scraper of claim 7, wherein when the blade is on the right side of the wiper and the right contact bar contacts the second wall of the housing to generate the second torque on the vertical axis, the blade rotates to the left, scrapes the wiper and stops on the left side of the wiper.

* * * * *